US011225952B2

(12) United States Patent
Park

(10) Patent No.: US 11,225,952 B2
(45) Date of Patent: Jan. 18, 2022

(54) FLUID PUMP

(71) Applicants: Tera Pump, Santa Ana, CA (US); Dukshin Corp., Ltd., Incheon (KR)

(72) Inventor: Kyung Suh Park, Suwon-si (KR)

(73) Assignees: TERA PUMP, Santa Ana, CA (US); DUKSHIN CORP., LTD., Incheon (KR)

( * ) Notice: Subject to any disclaimer, the term of this patent is extended or adjusted under 35 U.S.C. 154(b) by 0 days.

(21) Appl. No.: 16/987,215

(22) Filed: Aug. 6, 2020

(65) Prior Publication Data

US 2021/0148347 A1 May 20, 2021

(30) Foreign Application Priority Data

Nov. 20, 2019 (KR) ..... 10-2019-0149317

(51) Int. Cl.
*F04B 45/02* (2006.01)
*F04B 17/03* (2006.01)
*F04B 53/06* (2006.01)

(52) U.S. Cl.
CPC ..... *F04B 17/03* (2013.01); *F04B 45/02* (2013.01); *F04B 53/06* (2013.01)

(58) Field of Classification Search
CPC ..... F04B 17/03; F04B 45/02; F04B 53/06; F04D 13/068; F04D 15/0083; F04D 27/009; F04D 29/08; F04D 29/086
See application file for complete search history.

(56) References Cited

U.S. PATENT DOCUMENTS 2,759,476 A * 8/1956 Henderson ..... A61M 1/63 604/151
2,950,030 A * 8/1960 McConnohie ..... B05B 11/3032 222/189.1
3,475,719 A * 10/1969 Akin ..... G01F 23/242 439/668
4,863,070 A * 9/1989 Andris ..... G01F 11/08 222/207
8,500,706 B2 * 8/2013 Michaels ..... A61M 1/67 604/319
10,471,453 B2 * 11/2019 Saravia Castillon ... B05B 15/65
2010/0012559 A1 * 1/2010 Arita ..... A01K 63/006 210/120

FOREIGN PATENT DOCUMENTS

KR 200212990 Y1 2/2001
KR 20010017713 A 3/2001

* cited by examiner

*Primary Examiner* — Patrick Hamo
(74) *Attorney, Agent, or Firm* — Kirton McConkie; Evan R. Witt

(57) ABSTRACT

A fluid pump includes a pump body with a manual operation bulb or a power supply unit provided on an upper end and an inlet and an outlet provided on both sides of a liquid passage. A suction pipe connected to the inlet of the pump body includes a bendable part between an upper suction pipe part and a lower suction pipe part which are formed in a rigid rod shape. A discharge hose shaped as a bellows tube is connected to the outlet of the pump body. A pipe sleeve has ends partially fitted into the upper suction pipe part and the lower suction pipe part. It is installed on the outer circumferential surface of the suction pipe and shaped as a cylinder or a "C" with one end cut out from the cylinder to facilitate moving its position from the bending part to the upper suction pipe part.

5 Claims, 7 Drawing Sheets

FLUID PUMP

BACKGROUND OF THE INVENTION

Technical Field

The present invention relates to a fluid pump and, more specifically, to a fluid pump, which is easy to carry and store when not in use and can be reduced in packaging volume so as to reduce transportation costs by minimizing the length thereof when packaging and transporting the fluid pump that discharges fluid, which is sucked through a suction pipe, through a discharge pipe.

Background Art

In general, a fluid pump is a device that allows fluid inside a container to be sucked and then discharged through a discharge pipe at the other side, and is divided into a manual fluid pump and an electric motor type automatic fluid pump.

The manual fluid pump includes an operation bulb provided at the upper side of a pump body so as to carry out pumping operations by hand and a discharge pipe and a suction pipe respectively provided on one side surface and the bottom surface of the pump body, wherein fluid is pumped and discharged by a method of inserting the suction pipe into a fluid container and repeatedly pressing and releasing the operation bulb.

The electric automatic fluid pump includes a battery and a switch, which are provided as a power supply unit on the upper side of the pump body, and a discharge pipe and a suction pipe, which are installed as those of the manual fluid pump, wherein fluid is automatically suctioned and pumped using the power of a suction fan driven by a motor provided at the lower end of the suction pipe.

Most of the suction pipes of these fluid pumps have a rigid long rod-shaped hose structure, and the discharge pipes have a bellows tube-shaped synthetic resin hose structure with good bendability.

Among these fluid pumps, as prior art of such a manual fluid pump, Patent Document 1 below discloses the "Air vent device of fluid pump" of Korean Reg. Utility Model No. 20-0212990 (published on 15 Dec. 2001) which has been previously filed and proposed by the present applicant, wherein the air vent device of a fluid pump has a structure with a suction pipe made of a rigid long rod-shaped hose and a discharge pipe made of a bellows tube-shaped synthetic resin hose having good bendability, respectively provided on one side surface and the bottom surface of a pump body.

In addition, as prior art of such an electric automatic fluid pump, Patent Document 2 below discloses the "Fluid pump" of Korean Patent Publication No. 2001-0017713 (published on 5 Mar. 2001) which has been previously filed and proposed by the present applicant, wherein the fluid pump also has a structure with a suction pipe made of a rigid long rod-shaped hose and a discharge pipe made of a bellows tube-shaped synthetic resin hose having good bendability, respectively provided on one side surface and the bottom surface of a pump body.

PRIOR ART DOCUMENTS

Patent Documents (Patent Document 1) Korean Reg. Utility Model No. 20-0212990 (published on 15 Dec. 2001) "Air vent device of fluid pump"

(Patent Document 2) Korean Patent Publication No. 2001-0017713 (published on 5 Mar. 2001) "Fluid pump"

Problems to be Solved by the Invention

However, there is a problem that when it is intended to package and transport all the fluid pumps including the manual type and the electric type, the fluid pumps have too long packaged length even if the soft discharge pipe is closely attached to the long rod-type suction pipe as much as possible, resulting in excessive packaging and transportation costs.

In addition, there is a problem that careless transportation and storage may cause the rigid long rod-shaped suction pipe provided at the lower portion of the pump body to be easily bent and damaged, thereby reducing durability and deteriorating suction power.

Therefore, the present invention has been developed to solve the above problems and has an objective to provide a fluid pump, which can be packaged in a small size by reducing the length of a packaged suction pipe as much as possible at the time of packaging for distribution, thereby saving packaging and transportation costs.

Another objective of the present invention is to provide a fluid pump, in which when a suction pipe is pulled out of the fluid in a fluid container after the operation of the pump is stopped, the fluid on a bellows tube-shaped bending part can flow down more quickly so that it is possible to prevent contamination of the floor by dripping fluid when the suction pipe is removed from the fluid container.

A further objective of the present invention is to provide a fluid pump, in which a discharge pipe can be maintained as close as possible to a suction pipe, thereby providing good workability during packaging and facilitating storage.

SUMMARY OF THE INVENTION

Means to Solve the Problems

The objective can be achieved by providing a fluid pump, comprising: a pump body including a manual operation bulb or a power supply unit, which has a battery and a switch, provided on an upper end and having an inlet and an outlet provided on both sides of a liquid passage inside; a suction pipe connected to the inlet of the pump body and including a bending part formed in the shape of a bellows tube between an upper suction pipe part and a lower suction pipe part which are formed in a rigid rod shape; a discharge hose formed in the shape of a bellows tube and connected to the outlet of the pump body; and a pipe sleeve formed with length of which both ends are partially fitted into the upper suction pipe part and the lower suction pipe part of the suction pipe, and installed on the outer circumferential surface of the suction pipe in the shape of a cylinder or a "C" with one end cut out from the cylinder shape so as to move from a bending part position to an upper suction pipe part position.

Another objective of the present invention can be achieved by providing a fluid pump formed in a configuration, in which an upper display part of the upper suction pipe part and a lower display part of the lower suction pipe part, which confirm the movement position of the pipe sleeve, are provided with vents reaching the bending part, support protrusions are provided on the inner ends of the vents so as to tightly fit the pipe sleeve into the vents, and a plurality of fluid passages are provided between the support protrusions so that atmospheric pressure acts in the vents and the fluid passages.

A further objective of the present invention can be effectively achieved by providing a fluid pump, in which the discharge hose includes a rod-shaped discharge pipe provided at the front end thereof, and the pipe sleeve includes a plurality of holders provided on the outer surface thereof so as to fit the lower suction pipe part, the discharge hose, and the discharge pipe into the plurality of holders.

Effects of the Invention

This present invention has the effects that the rod-shaped suction pipe can be used owing to the movable pipe sleeve and the length of the suction pipe can be folded in half by the bending part so that the length of the suction pipe is reduced as much as possible in addition to the discharge hose that can easily fold with flexibility during packaging and storage, thereby facilitating the packaging for distribution or storage after use owing to the small size.

In addition, there are the effects that through the vents and the fluid passages provided in the upper suction pipe part and the lower suction pipe part constituting the suction pipe, atmospheric pressure can act smoothly on the fluid filled between the pipe sleeve and the bending part so that when the suction pipe is removed from the fluid container after the pump is used, the fluid filled between the pipe sleeve and the bending part can quickly flow out and fall down with no fear of contaminating the floor.

Furthermore, the lower suction pipe, the discharge hose, and the discharge pipe can be packaged for distribution in a state, in which the folded state of the lower suction pipe, the discharge hose, and the discharge pipe is maintained in good condition, by the plurality of holders provided on the outer circumferential surface of the pipe sleeve, thereby improving workability. In addition, after a consumer purchases, the folded state can be maintained in a reduced state as much as possible, thereby facilitating carrying and storage.

DETAILED DESCRIPTION OF THE INVENTION

Hereinafter, exemplary embodiments of the present invention will be described for structural or functional description, so the scope of the present invention should not be interpreted as being limited by the embodiments specified in the text.

That is, since the embodiments can be variously modified and have various forms, it should be understood that the scope of the present invention includes equivalents capable of realizing technical ideas.

In addition, the purpose or effect presented in the present invention does not mean that a specific embodiment should include all or only such an effect, so the scope of rights of the present invention should not be understood as being limited thereby.

Hereinafter, preferred technical features and operational effects capable of effectively achieving the characteristics of the present invention will be described in detail with reference to the accompanying drawings.

Figure 1:
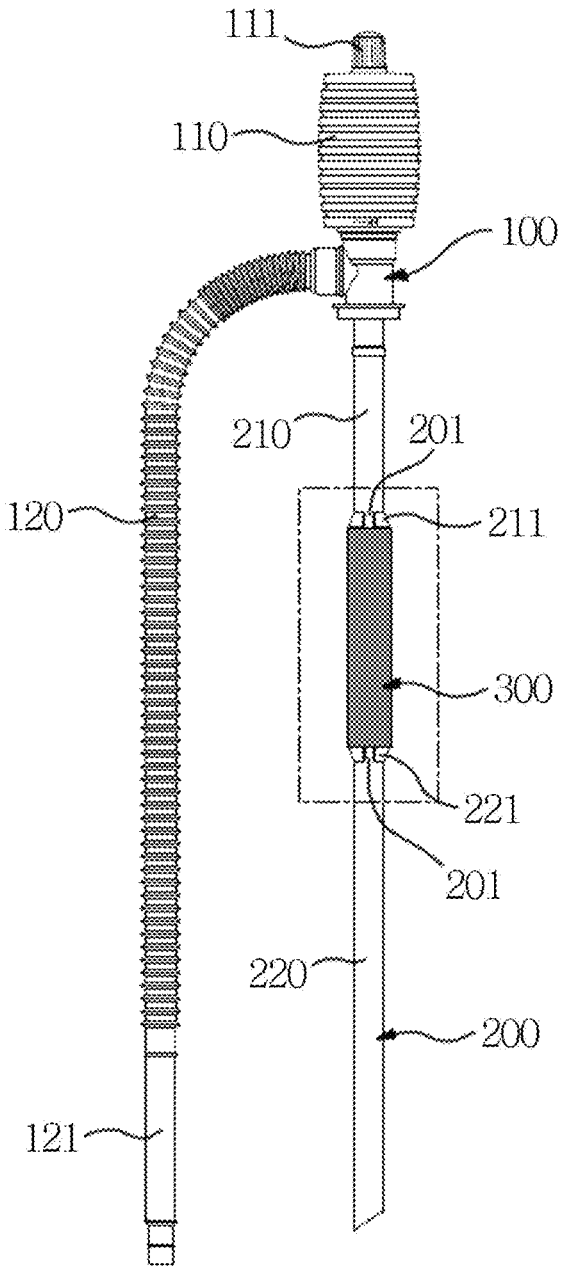
FIG. 1 is a front view showing an example of a fluid pump according to an embodiment of the present invention.
Figure 2:
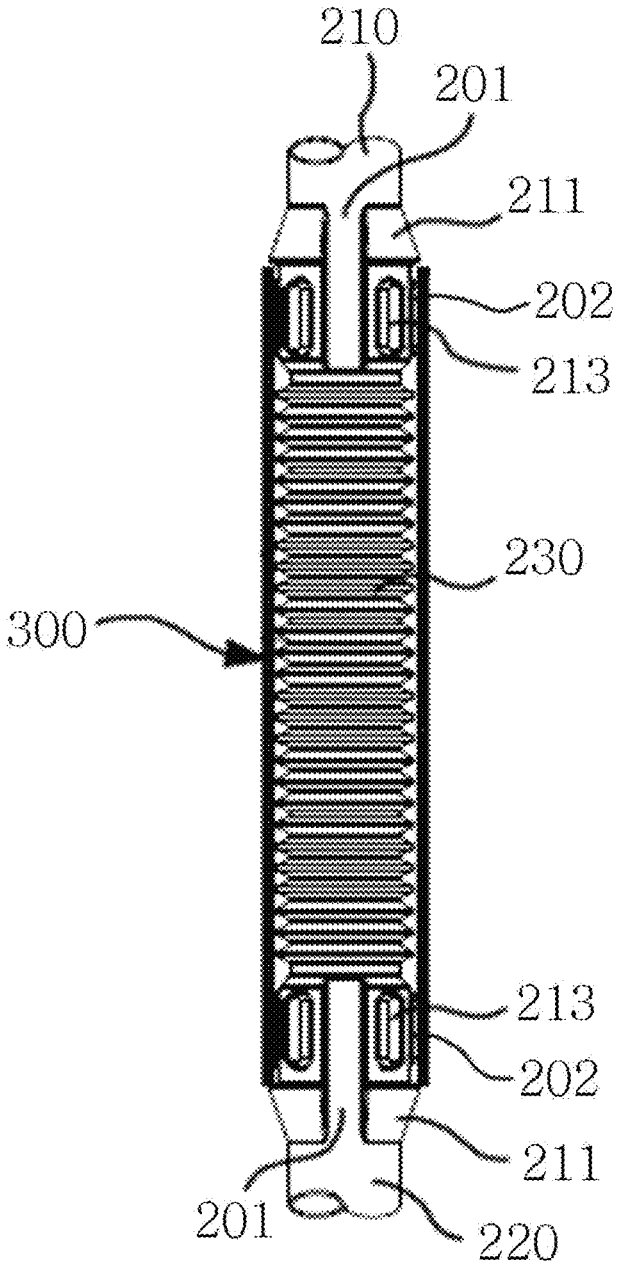
FIG. 2 is a partial sectional view showing the installation state of a suction pipe and a pipe sleeve in the present invention.
Figure 3:
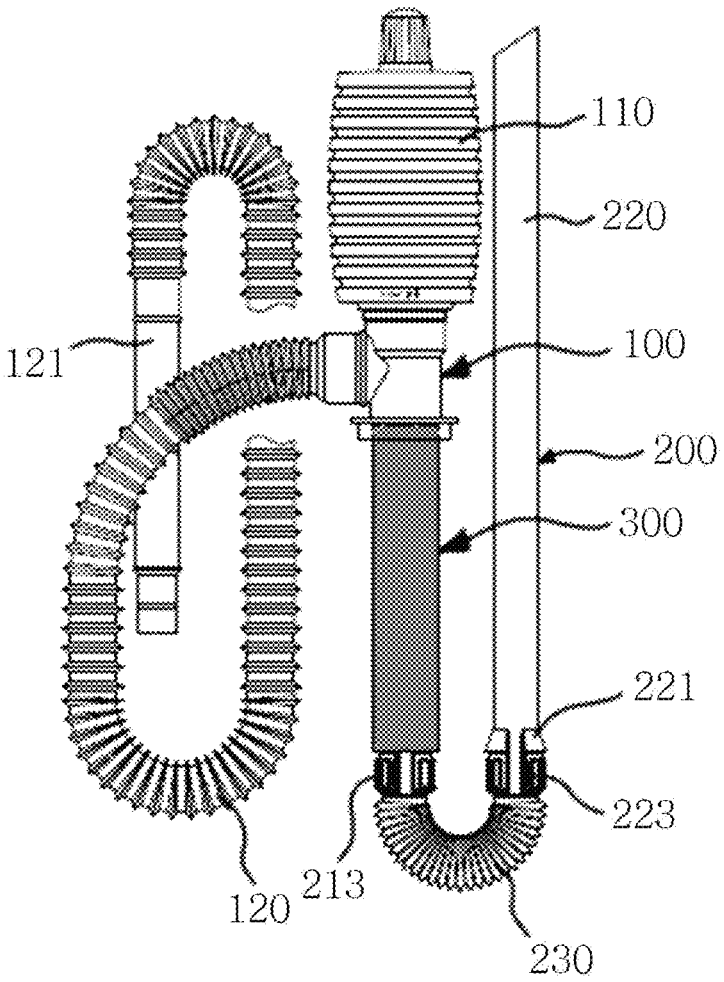
FIG. 3 is a view showing a state, in which a suction pipe and a discharge hose are folded in the fluid pump of FIG. 1.

FIG. 1 is a front view showing an example of a fluid pump according to an embodiment of the present invention, FIG. 2 is a partial sectional view showing the installation state of a suction pipe and a pipe sleeve in the present invention, and FIG. 3 is a view showing a state, in which a suction pipe and a discharge hose are folded in the fluid pump of FIG. 1.

The fluid pump of the present invention shown herein can be applied to both an automatic fluid pump equipped with a power supply unit having a battery and a switch or a manual fluid pump with a manual operation bulb 110 provided at an upper end, but the manual fluid pump equipped with the manual operation bulb 110 as shown in the accompanying drawings will be described as an example hereinafter.

The fluid pump of the present invention includes a pump body 100, a suction pipe 200, a discharge hose 120, and a pipe sleeve 300 and can be packaged and stored reducing the length of the suction pipe 200 at the time of packaging and storage.

The pump body 100 includes an inlet and an outlet respectively provided at both sides of a liquid passage inside and an operation bulb 110 provided at the upper portion so as to carry out pumping operations through a check valve provided inside a cap 111 when repeatedly pressing and releasing the operation bulb by hand.

The suction pipe 200 is connected to the inlet of the pump body 100 so as to allow fluid inside a fluid container to be introduced into the liquid passage inside the pump body 100 through the inlet of the pump body 100 during the pumping operations of the operation bulb 110 and has a structure, in which a rigid rod-shaped upper suction pipe part 210 and a lower suction pipe part 220 are provided so as to be spaced apart from each other at a predetermined interval and connected by a bellows tube-shaped bending part 230.

The discharge hose 120 is connected to the outlet of the pump body 100 so as to receive and discharge fluid when the fluid introduced into the pump body 100 is guided to the outlet during the pumping operations of the operation bulb 110, wherein the discharge hose 120 is in the form of a bellows tube and thus has the flexibility to bend freely.

The pipe sleeve 300 is formed with the length, of which both ends are partially fitted into the upper suction pipe part 210 and the lower suction pipe part 220 of the suction pipe 200, and installed on the outer circumferential surface of the suction pipe 200 in the shape of a cylinder or a "C" with one end cut out from the cylinder so as to move from a bending part 230 position to an upper suction pipe part 210 position.

When using the fluid pump of the present invention as above, the pipe sleeve 300 is placed at the bending part 230 position. Then, the both ends of the pipe sleeve 300 are partially fitted into the upper suction pipe part 210 and the lower suction pipe part 220 and thus not only covers the bending part 230 so that the bending part 230 cannot be seen but also supports the portion between the upper suction pipe part 210 and the lower suction pipe part 220 so that the entire suction pipe 200 forms an integral bar shape, thereby being easily inserted into the inlet of the fluid container.

This present invention includes, as shown in FIG. 1, an upper display part 211 and a lower display part 221 provided in a protruding shape so as to confirm the position of the pipe sleeve 300 at the end portions of the upper suction pipe part 210 and the lower suction pipe part 220, which are connected to the bending part 230, wherein if the pipe sleeve 300 is cylindrical, it is preferable to provide vents 201 having a groove shape and reaching up to the bending part 230 on both sides or every side of the upper display part 211 and the lower display part 221. Herein, it is preferable that the vents 201 are provided only in the case where the pipe sleeve 300 is cylindrical.

In addition, it is preferable to provide a predetermined gap spacing between the outer circumferential surface of the bending part 230 and the pipe sleeve 300 as shown in FIG. 2. Then, when the suction pipe 200 is pulled out from the fluid in the fluid container after the operation of the pump is stopped, the atmospheric pressure acting through the vents 201 is evenly applied to the fluid filled and remaining in the gap between the outer circumferential surface of the bending part 230 and the pipe sleeve 300, so that the fluid filled and remaining in the gap can fall down more quickly.

In other words, if the fluid filled in the gap between the outer circumferential surface of the bending part 230 and the pipe sleeve 300 does not flow down quickly when stopping the use of the fluid pump, of which the suction pipe 200 is inserted in the fluid in the fluid container, and pulling the suction pipe 200 out of the fluid container, the fluid pump has to be held for a long time until the remaining fluid flows down, wherein if the fluid pump is put on the floor without waiting for this, then the floor is contaminated by the late flowing fluid.

However, according to the present invention, when the operation of the pump is stopped and the suction pipe 200 is pulled out of the fluid in the fluid container, the atmospheric pressure acts on the fluid filled and remaining in the gap between the outer circumferential surface of the bending part 230 and the pipe sleeve 300 through the vents 201 formed on the upper display part 211 and the lower display part 221, so that the fluid remaining in the gap is induced to drop into the fluid container quickly and thus it is not necessary to hold the fluid pump for a long time, wherein the vents 201 are preferably provided only in the case where the pipe sleeve 300 is cylindrical.

In addition, according to the present invention, it is preferable that a plurality of support protrusions 213, 223 with fluid passages 202 provided therebetween are provided in a protruding shape at the end portion of the upper suction pipe part 210 and the end portion of the lower suction pipe part 220, which are connected by the bending part 230, so as to be in tight contact with the pipe sleeve 300, as shown in FIG. 3.

Then, when the pipe sleeve 300 is moved from the upper suction pipe part 210 to the bending part 230 position, the upper end and the lower end of the pipe sleeve 300 come into tight contact with the support protrusions 213, 223 at the end portion of the upper suction pipe part 210 and the end portion of the lower suction pipe part 220, thereby maintaining the position of the moved pipe sleeve 300 very firmly.

Furthermore, according to the present invention, the discharge hose 120 can be folded with its own flexibility towards the operation bulb 110, as shown in FIG. 3, and the bending part 230 is exposed to the outside, when the pipe sleeve 300 is pushed up towards the upper suction pipe part 210, so that the lower suction pipe part 220 can be folded towards the operation bulb 110 by using the bending part 230, allowing the overall length of the pump to be reduced as small as possible. Therefore, the size of the pump during the packaging for distribution is reduced as much as possible, thereby facilitating carrying and storage.

Figure 4:
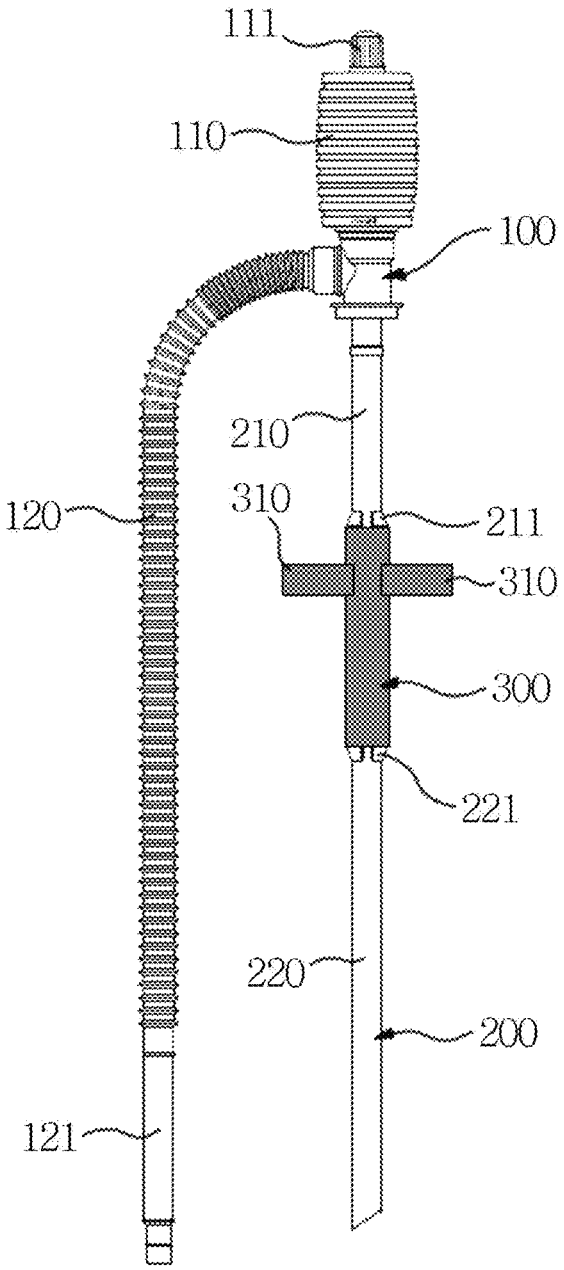
FIG. 4 is a front view showing a fluid pump according to another embodiment of the present invention.
Figure 5:
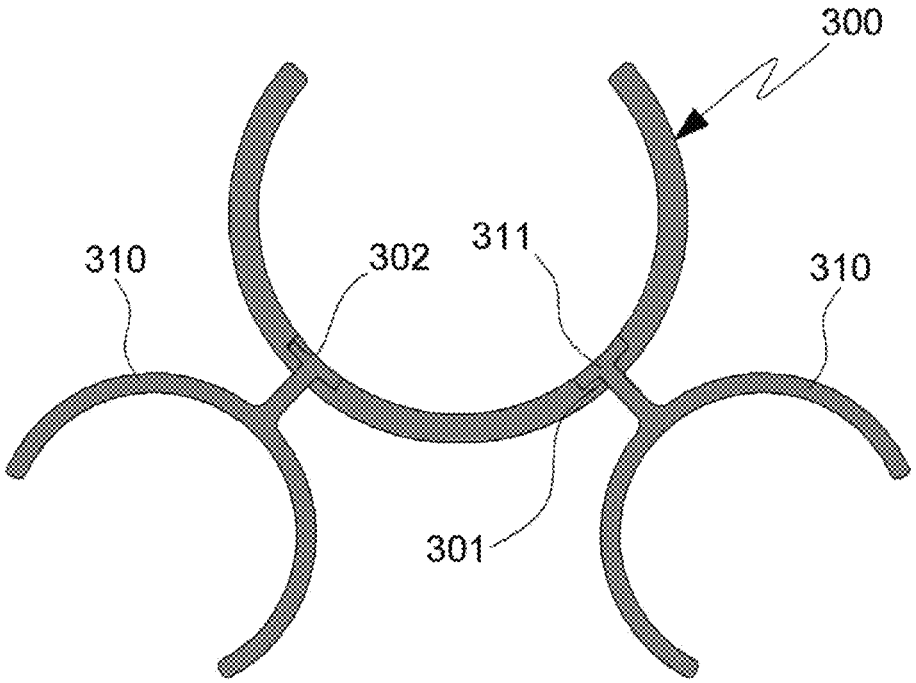
FIG. 5 is a plane view showing a pipe sleeve structure as an example in the fluid pump of FIG. 4.
Figure 6:
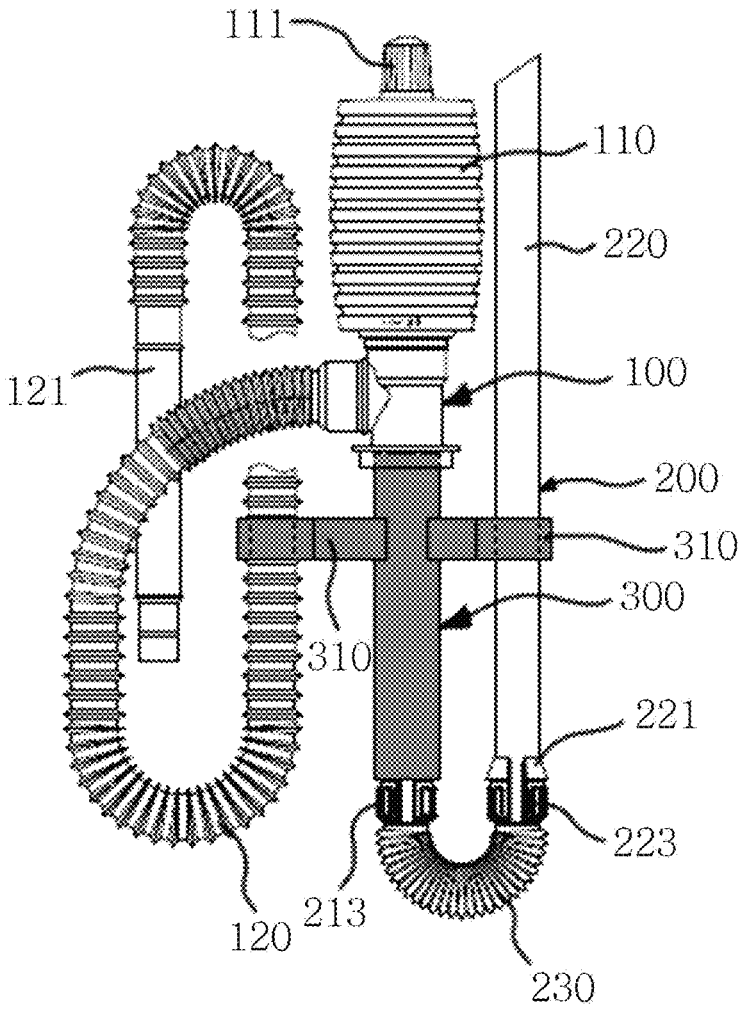
FIG. 6 is a view showing a state, in which a suction pipe and a discharge hose are fitted into holders in the fluid pump of FIG. 4.

FIG. 4 to FIG. 6 are views showing another embodiment of the present invention, in which FIG. 4 is a front view showing a fluid pump according to another embodiment of the present invention, FIG. 5 is a plane view showing a pipe sleeve structure as an example in the fluid pump of FIG. 4, and FIG. 6 is a view showing a state, in which a suction pipe and a discharge hose are folded and fitted into holders in the fluid pump of FIG. 4.

Referring to FIG. 4 and FIG. 5, the discharge hole 120 may include a rod-shaped discharge pipe 121 provided at the front end thereof and the pipe sleeve 300 may include a plurality of holders 310 provided on the outer surface thereof so that the lower suction pipe part 220, the discharge hose 120, and the discharge pipe 121 are fitted into the holders 310.

Herein, even though FIG. 5 shows the pipe sleeve 300 including two holders 310, which are provided on the outer circumferential surface thereof and formed in the shape of a "C" with one end cut out, it is also possible to form the pipe sleeve 300 in a cylindrical shape and to provide three or more holders 310.

Then, if the lower suction pipe part 220 folded using the bending part 230 that is exposed as the pipe sleeve 300 is moved towards the upper suction pipe part 210 side is fitted into the holder 310 at one side so as to be fixed thereto and either or both of the discharge hose 120 and the discharge pipe 121 are fitted into the remaining holders 310, as shown in FIG. 6, then the folded state of the lower suction pipe part 220, the discharge hose 120, and the discharge pipe 121 can be maintained satisfactorily.

Figure 7:
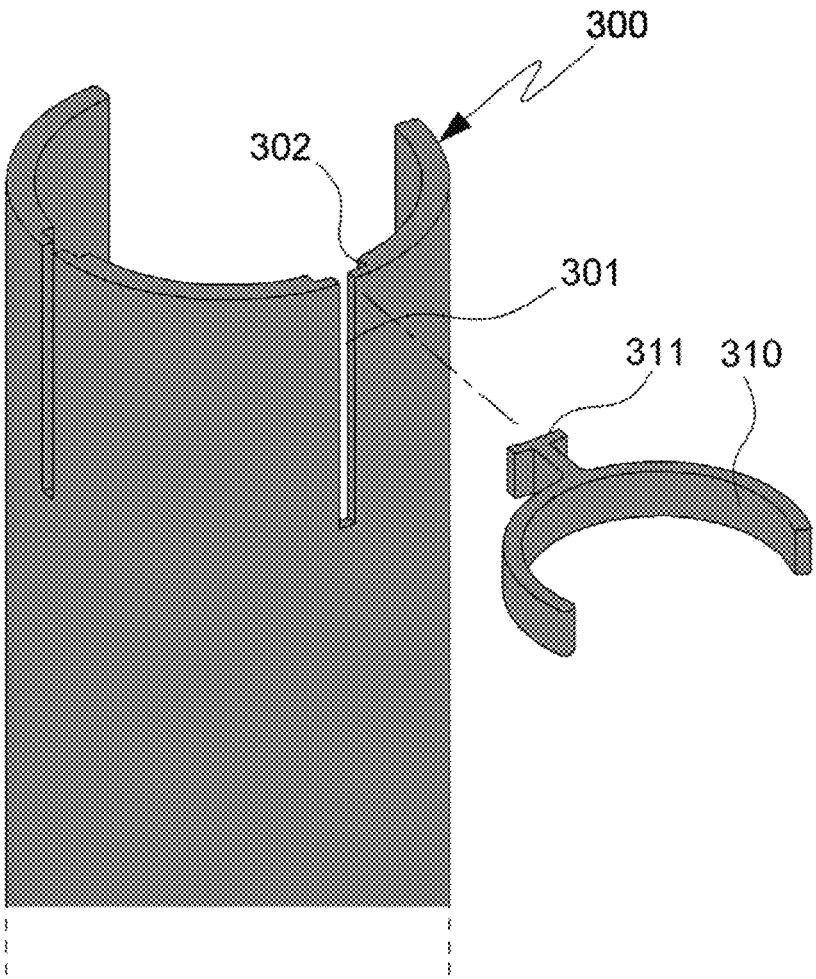
FIG. 7 is an exploded perspective view showing an example of the assembly structure of the pipe sleeve and the holder shown in FIG. 5.

Meanwhile, as shown in FIGS. 5 and 7, it is preferable that the holder 310 is made of a synthetic resin material and formed into a "C" type structure so that the inlet thereof is elastically opened and then restored, and it is also possible to form the holder 310 to be assembled to outer surface of the pipe sleeve 300 by means of an attachment and detachment means.

As an example of such an attachment and detachment means, as shown in FIG. 7, the pipe sleeve 300 is provided with assembly grooves 301 each having a locking protrusion 302 on the inner surface thereof at two or three positions according to the assembly positions of the holders 310, and the holder 310 is provided with a holding protrusion 311 at the rear so as to be caught by the locking protrusion 302, so that the plurality of holders 310 can be easily attached to or detached from the pipe sleeve 300.

Herein, if the pipe sleeve 300 is moved to the upper suction pipe part 210, the opening portion of the assembly groove 301 comes into close contact with the bottom surface of the pump body 100 so as to be maintained in a closed state so that the holder 310 fitted into the assembly groove 301 is maintained in the assembled state in good condition without escaping from the assembly groove 301.

Therefore, the lower suction pipe part 220, the discharge hose 120, and the discharge pipe 121 can be kept in good condition in the state that the lower suction pipe part 220, the discharge hose 120, and the discharge pipe 121 are folded and fitted into the holders 310.

Herein, it is preferable that the holding protrusion 311 of the holder 310 is formed to a thickness so as to be tightly fitted into the assembly groove 301. Then, even if the pipe sleeve 300 is at the bending part 230 position, there is no fear that the holder 310 is easily removed through the opening of the assembly groove 301.

Although not shown in the drawings, in order to reinforce the prevention of the separation of the holder 310, it is also possible to block the opening of the assembly groove 301 by providing an auxiliary lid, which has holding protrusions provided at both sides thereof and fitted into the locking protrusions 302 in the same manner as the holding protrusion 311 of the holder 310.

It is also possible that the holder 310 is formed to be detachable and is used to fix the suction pipe 200 and the discharge hose 120 in the folded state as described above and the holder 310 after use can also be stored as being fitted into the pipe sleeve 300.

As described above, the present invention has good workability in packaging for distribution and is very easy to carry and store after using the pump, since the folded state of the lower suction pipe part 220, the discharge hose 120, and the discharge pipe 121 can be maintained using the plurality of holders 310 provided on the pipe sleeve 300.

EXPLANATION OF REFERENCE SYMBOLS

| | |
|---|---|
| 100: Pump body | 110: Operation bulb |
| 120: Discharge hose | 121: Discharge pipe |
| 200: Suction pipe | 202: Fluid passage |
| 210: Upper suction pipe part | 211: Upper display part |
| 213, 223: Support protrusion | 220: Lower suction pipe part |
| 221: Lower display part | 230: Bending part |
| 300: Pipe sleeve | 310: Holder |

What is claimed is:

1. A fluid pump, comprising:

a pump body including a manual operation bulb or a power supply unit, which has a battery and a switch, provided on an upper end, and having a liquid passage inside the pump body having an inlet side and an outlet side, an inlet is provided on the inlet side and an outlet is provided on the outlet side;

a suction pipe connected to the inlet of the pump body and including a bending part formed in the shape of a bellows tube between an upper suction pipe part and a lower suction pipe part which are formed in a rigid rod shape;

a discharge hose formed in the shape of a bellows tube and connected to the outlet of the pump body; and a pipe sleeve formed with a length of which a first end is partially fitted into the upper suction pipe part and a second end opposite the first end is partially fitted into the lower suction pipe part of the suction pipe, and installed on the outer circumferential surface of the suction pipe in the shape of a cylinder or in the shape of a cylinder with a cut out such that it is C-shaped in cross-section so as to move from a bending part position to an upper suction pipe part position, wherein the length of the suction pipe is reduced during packaging and storage so that the fluid pump can be packaged and stored in a small volume.

2. The fluid pump according to claim 1, wherein an upper display part for confirming the position of the pipe sleeve is protrudingly provided on the end portion of the upper suction pipe part connected to the bending part, and a lower display part for confirming the position of the pipe sleeve is protrudingly provided on the end portion of the lower suction pipe part connected to the bending part, the upper display part and the lower display part are each provided with a plurality of vents reaching the bending part in the case where the pipe sleeve has a cylindrical shape, and if the suction pipe is pulled out of fluid in a fluid container after the operation of the pump is stopped, the fluid filled and remaining between an outer circumferential surface of the bending part and the pipe sleeve is quickly recovered by atmospheric pressure through the plurality of vents.

3. The fluid pump according to claim 1, wherein a first plurality of support protrusions provided with a first fluid passage therebetween are protrudingly formed on the end portion of the upper suction pipe part connected to the bending part and a second plurality of support protrusions with a second fluid passage therebetween are formed on the end portion of the lower suction pipe part, connected to the bending part, so as to come into tight contact with the pipe sleeve so that the position of the pipe sleeve is fixed, and a predetermined gap is provided between the bending part and the pipe sleeve so that, when the operation of the pump is stopped, the fluid filled and remaining in the gap falls quickly by the atmospheric pressure acting in the gap.

4. The fluid pump according to claim 1, wherein the discharge hose includes a rod-shaped discharge pipe provided at a front end thereof, and the pipe sleeve includes a plurality of holders provided on the outer surface thereof so as to fit the lower suction pipe part, the discharge hose, and the discharge pipe into the plurality of holders so that packaging or storing is carried out in a state, in which the folded state of the lower suction pipe part, the discharge hose, and the discharge pipe is maintained.

5. The fluid pump according to claim 4, wherein the holder is made of a synthetic resin material and has a "C"-shaped structure so as to be expand elastically when the lower suction pipe part, the discharge hose, and the discharge pipe are inserted, and the pipe sleeve and the holder are assembled detachably by a detachment and attachment means.

* * * * *